US009859067B2

(12) United States Patent
Tsukimori

(10) Patent No.: US 9,859,067 B2
(45) Date of Patent: Jan. 2, 2018

(54) LIMIT SWITCH

(71) Applicant: OMRON Corporation, Kyoto-shi, Kyoto (JP)

(72) Inventor: Kazuyuki Tsukimori, Okayama (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 14/943,263

(22) Filed: Nov. 17, 2015

(65) Prior Publication Data

US 2016/0141118 A1 May 19, 2016

(30) Foreign Application Priority Data

Nov. 19, 2014 (JP) ..... 2014-234889

(51) Int. Cl.

| | |
|---|---|
| ***H01H 1/02*** | (2006.01) |
| ***H01H 1/023*** | (2006.01) |
| ***H01H 19/18*** | (2006.01) |
| ***H01H 21/28*** | (2006.01) |

(52) U.S. Cl.

CPC ..... *H01H 1/02* (2013.01); *H01H 1/023* (2013.01); *H01H 19/18* (2013.01); *H01H 21/285* (2013.01); *H01H 2205/002* (2013.01)

(58) Field of Classification Search

CPC ..... H01H 1/02; H01H 1/023; H01H 19/18; H01H 21/285; H01H 2205/002

USPC ..... 200/235, 262–267, 237, 502

See application file for complete search history.

(56) References Cited

U.S. PATENT DOCUMENTS

| | | | | |
|---|---|---|---|---|
| 4,480,014 | A * | 10/1984 | Milligan | H01H 1/023 148/430 |
| 2014/0360849 | A1 | 12/2014 | Takahashi et al. | |
| 2015/0145619 | A1* | 5/2015 | Connell | H01H 47/18 335/63 |
| 2015/0206684 | A1 | 7/2015 | Naka et al. | |

FOREIGN PATENT DOCUMENTS

| | | | | |
|---|---|---|---|---|
| FR | 878452 | A | 1/1943 | |
| JP | H06-338235 | A | 12/1994 | |
| JP | H11238430 | A * | 8/1999 | H01H 21/285 |
| WO | 2013/105278 | A1 | 7/2013 | |
| WO | 2014087567 | A1 | 6/2014 | |

OTHER PUBLICATIONS

The Chinese office action letter issued on Apr. 13, 2017 in the counterpart Chinese patent application.

* cited by examiner

*Primary Examiner* — Anthony R. Jimenez

(74) *Attorney, Agent, or Firm* — Metrolexis Law Group, PLLC

(57) ABSTRACT

A limit switch includes fixed contacts and a movable contact, the fixed contacts and the movable contact formed from an Au—Ni metal alloy of no less than 97% Au by weight. The limit switch detects position, change, movement, number of passes, or the like and outputs an "on" signal or an "off" signal depending on whether a detection occurred.

1 Claim, 3 Drawing Sheets

LIMIT SWITCH

FIELD

The present invention relates to a limit switch.

BACKGROUND

Various types of electric contact materials have recently been proposed and widely implemented in switching devices such as micro-switches and limit switches.

For instance, the below mentioned Japanese Unexamined Patent Application Publication No. H06-338235, published 6 Dec. 1994 (Patent Document 1), proposes an electric contact material composed of 5 to 30% Ag by weight, 2 to 10% Pd by weight or 3 to 15% Pt by weight, 0.5 to 5% Ni by weight, with the Au as the remaining portion to give the electric contact material superior anti-stick and contact properties (contact reliability).

Technical Problem

However, when the above-mentioned kind of conventional electric contact material is adopted in a limit switch, the anti-stick property deteriorates for the pair of contacts therein made of the aforementioned electric contact material when a large contact load is applied to the contacts; conversely, the contact reliability, or the vibration resistance and the shock resistance of the limit switch deteriorates when the aforementioned contact load is reduced.

The present invention proposes further improving the contact reliability of a limit switch, which has a larger mass than a micro-switch.

SUMMARY

Solution to Problem

A limit switch according to an embodiment of the present invention includes fixed contacts and a movable contact formed from an Au—Ni metal alloy of no less than 97% Au by weight.

Effects

A limit switch according to the above-described embodiment of the invention exhibits improved contact reliability.

DETAILED DESCRIPTION

First Embodiment

Embodiments of the present invention are described below in detail with reference to FIG. 1 to FIG. 3.

Overview of the Limit Switch 1

Figure 2:
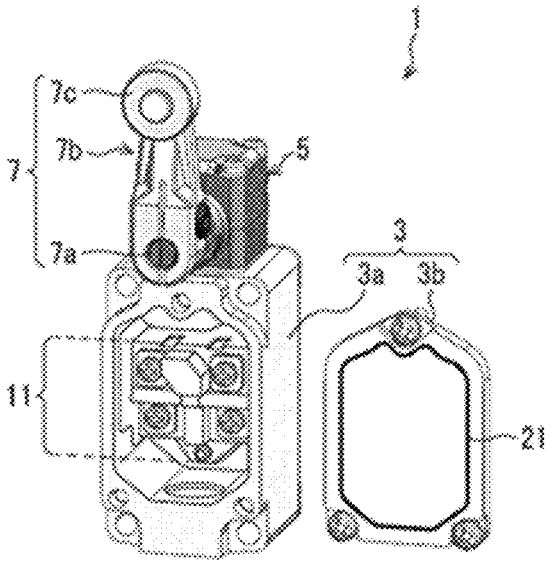
FIG. 2 is a perspective view of a limit switch containing the switching mechanism illustrated in FIG. 1.
Figure 3:
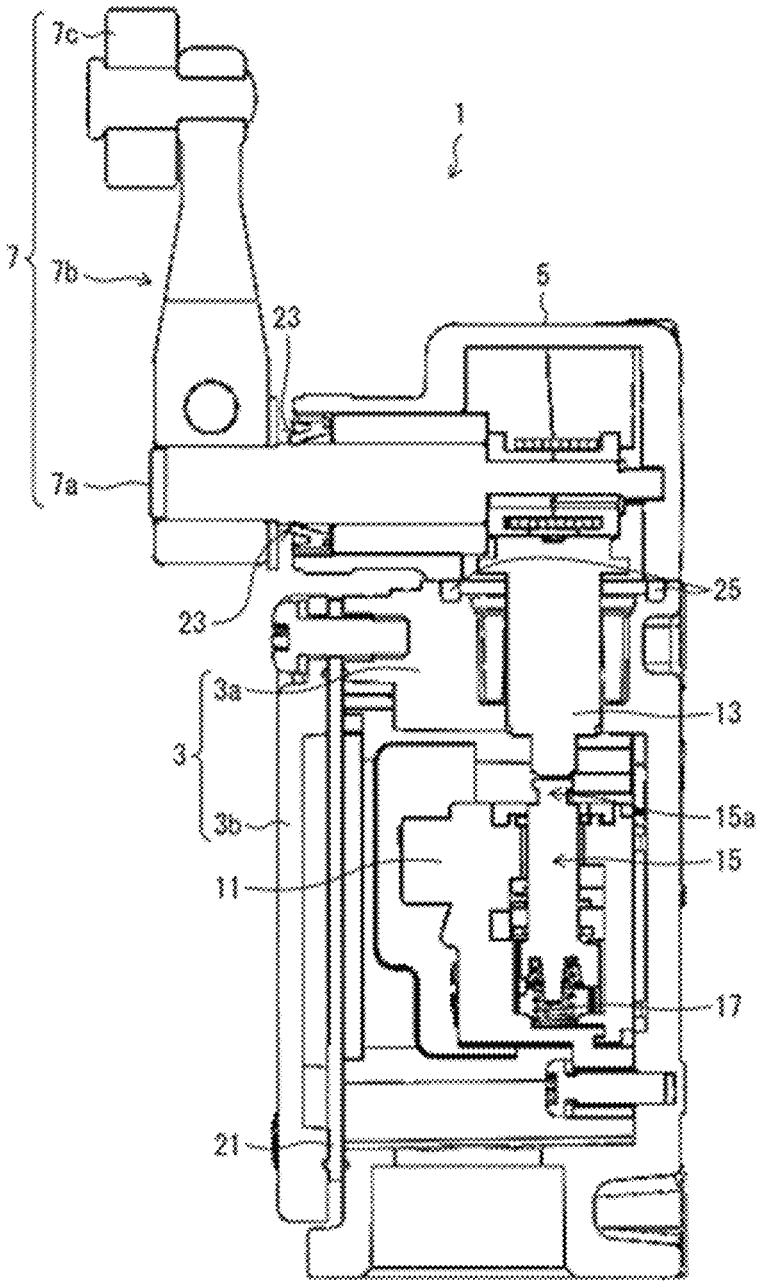
FIG. 3 is a cross-sectional view of a limit switch containing the switching mechanism illustrated in FIG. 1.

First, an overview of a limit switch 1 according to the first embodiment is described using FIG. 2 and FIG. 3. FIG. 2 is a perspective view of the limit switch 1, and FIG. 3 is a cross-sectional view of the limit switch 1. The limit switch 1 detects position, change, movement, number of passes, or the like and outputs an "on" signal or an "off" signal depending on whether a detection occurred.

As illustrated in FIG. 2 the limit switch 1 is equipped with a housing 3, a mounting block 5, and an actuator 7.

A switching mechanism 11 is housed within the space inside the housing 3; the aforementioned switching mechanism 11 is thereby protected from outside forces, water, oil, gas, dust and the like. The housing 3 is made up of a main unit 3*a* having an opening for receiving the switching mechanism 11 in the inside space, and a cover 3*b* for covering closing off the aforementioned opening. The physical properties for the housing 3 are not particularly limited and for instance, resin, metal or the like may be used therefor.

The mounting block 5 is attached to the upper portion of the housing 3. The actuator 7 is also installed on the mounting block 5 and is able to change its sliding position (i.e., is able to turn). The actuator 7 is provided with a rotation shaft 7*a*, an arm 7*b* (lever), and a roller 7*c* that comes in contact with an object (i.e., an object to be detected).

The actuator 7 protrudes from the mounting block 5 and has a fixed position when no outward forces are applied thereto due to contact with an object. That is, the actuator 7 does not rotate without coming into contact with an object. Here, the fixed position of the actuator 7 is depicted oriented towards twelve o'clock.

In FIG. 2 the actuator 7 rotates clockwise from the fixed position when a force is applied thereto from the left; thereafter, the actuator 7 returns to the fixed position once the force is removed. On the other hand the actuator 7 rotates anti-clockwise from the fixed position when a force is applied thereto from the right; thereafter, the actuator 7 returns to the fixed position once the force is removed. As is later described, the actuator 7 is configured such that the switching mechanism 11 operates when the actuator 7 rotates.

FIG. 3 depicts a plunger 13, and operation shafts 15 and a coiled spring 17. The plunger 17 is supported inside the main housing 3*a* and is able to move vertically; an end portion of the rotation shaft 7*a* of the actuator 7 comes into contact with one longitudinal end of the plunger.

The coil spring 17 applies a bias to the operation shaft 15 causing the plunger 13 to return to a reference position. The coil spring 17 raises the operation shaft 15 upward as far as possible whereat the location that the operation shaft 15 keeps the plunger 13 is the base position of the plunger 13.

At this point the rotation of the actuator 7 rotates the end portion of the rotation shaft 7*a*, so that a force may be applied to the plunger 13 lengthwise thereof.

As a result the plunger 13 is displaced lengthwise from the base position, driving the upper end part 15*a* of the operation shaft 15 which is exposed from the top surface of the switching mechanism 11 downward and pressing down the operation shaft 15.

Once the actuator returns to a fixed position, the plunger 13 also returns to the base position due to the biasing force of the coil spring 17. This kind of displacement of the plunger 13 and the operation shaft 15 opens and closes the contact (not shown) provided in the switching mechanism 11.

Note that, although later described in detail, the operation shaft 15 serves as a part of the switching mechanism 11; the external force added to the operation shaft 15 is transmitted to a later-described movable spring 111 thereby moving a movable contact, and opening and closing a switch.

Further details on the switching mechanism 11 are described below using FIG. 1.

Switching Mechanism

Figure 1:
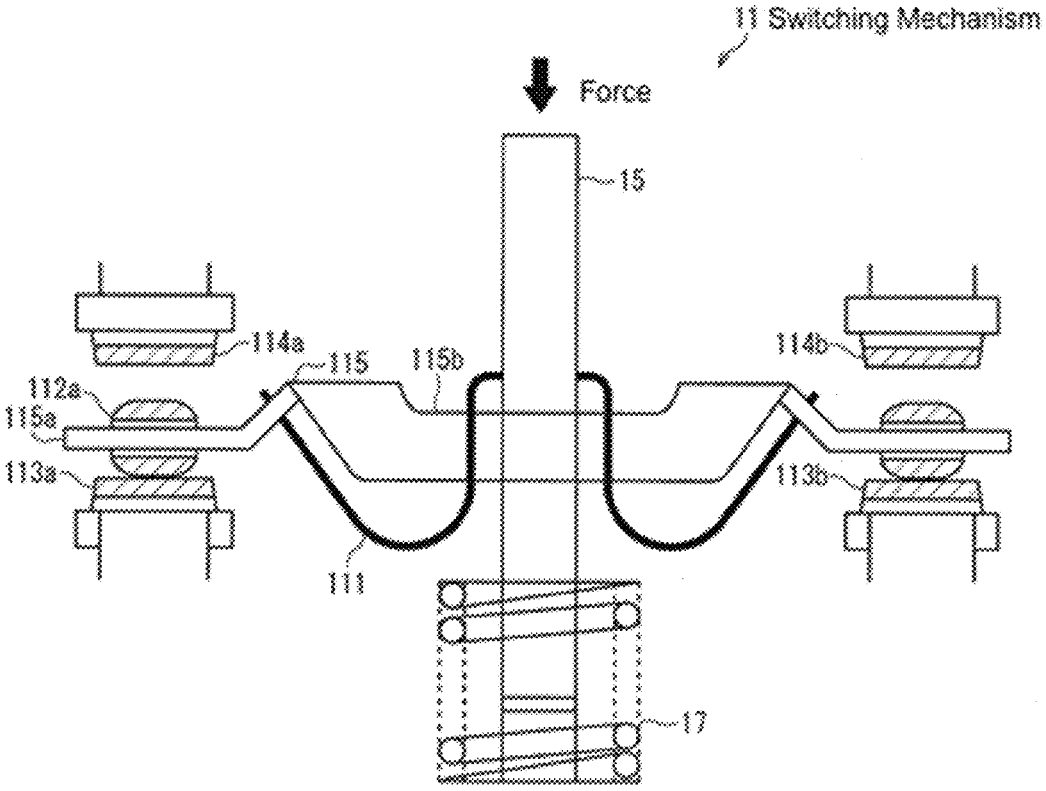
FIG. 1 is a diagram for explaining the main components of a switching mechanism according to a first embodiment of the present invention.

FIG. 1 is a diagram for explaining the main components of a switching mechanism 11.

As illustrated in FIG. 1, the switching mechanism 11 includes a movable spring 111 (contact pressure spring), a movable contact 112 (movable contact), a normally-closed fixed contact 113 (fixed contact), a normally-open fixed contact 114 (measurement contact), and a movable contact piece 115.

The normally-closed fixed contact 113 and the normally-open fixed contact 114 are fixed opposite each other.

The movable contact 112, which separates the normally-closed fixed contact 113 and the normally-closed fixed contact 113 is fixed to the tip end portion 115*a* of the movable contact piece 115. The operation shaft 15 is also arranged on the base end portion 115*b* of the movable contact piece 115.

Note that the movable contact 112, the normally-closed fixed contact 113, and the normally-open fixed contact 114 are preferably formed from an Au—Ni alloy of no more than 97% Au by weight. The details therefor are described using Table 1.

The movable spring 111 can change the contact of a switch, and is for instance a conductive spring material. The movable spring 111 changes the movable contact 112 from a state of being in contact with the normally-closed fixed contact 113, to a state of being in contact with the normally-open fixed contact 114; the movable spring 111 also changes the movable contact 112 from a state of being in contact with the normally-open fixed contact 114 to a state of being in contact with the normally-closed fixed contact 113.

While described later using Table 1, the movable spring 111 preferably applies a contact load of no less than 40 gf to a separable contact pair among the movable contact 112, and the normally-closed fixed contact 113 and the normally-open fixed contact 114.

Here, as described using FIG. 3, the rotation of the actuator 7 displaces the plunger 13 from the base position downward (FIG. 3) which causes the plunger 13 to press the operation shaft 15 downward. When the operation shaft 15 is pressed downward, pushing down the movable contact piece 115 in resistance to the movable spring 111, the counterforce of the movable spring 111 causes the movable contact piece 115 to move in reverse, with the snap action switching the movable contact 112 from contact with the normally-closed fixed contact 113 to contact with the normally-open fixed contact 114. Releasing the pressing force on the operation shaft 15 also causes the snap action to switch the movable contact 112 from contact with the normally-open fixed contact 114 to contact with the normally-closed fixed contact 113, i.e., the movable contact 112 returns to the state illustrated in the drawings.

Note that although a double break mechanism is provided as an example of the switching mechanism 11 in FIG. 1, the switching mechanism 11 may also be double through mechanism.

Furthermore, while the movable contact 112 described in the above-mentioned working example is a micro-switch that comes into contact with the normally-open fixed contact 114 and the normally-closed fixed contact 113, one of the above-mentioned normally-open fixed contact 114, and normally-closed fixed contact 113 may be excluded.

The contact reliability and the adhesion characteristics, and the like of the limit switch 1 are described in detail below.

Characteristics of the Limit Switch 1

The inventors of the present invention (referred to below as "the inventors") developed the limit switch 1 to address improving the contact reliability of a limit switch. Here, the "contact reliability of a limit switch" signifies that the movable contact (e.g., the movable contact 112) and the fixed contacts (e.g., the normally-closed fixed contact 113, and the normally-open fixed contact 114) of the limit switch are conducting electricity reliably, and there is no failure in conducting the electricity. That is, the "contact reliability of a limit switch" means "the circuit can be reliably switched."

The inventors adopted the following two techniques to improve the contact reliability of the limit switch 1. Namely, first, the inventors increased the contact load applied to a separable contact pair among the movable contact 112, and the normally-closed fixed contact 113 and the normally-open fixed contact 114.

Second, the inventors reduced the degree of hardness of the material used for the movable contact 112, the normally-closed fixed contact 113 and the normally-open fixed contact 114 to ensure the contacts were softer. Increasing the contact load applied to the contact pairs, and reducing the degree of hardness of the material used for the movable contact 112, the normally-closed fixed contact 113, and the normally-open fixed contact 114 thereby allows for increasing the contact surface area between the movable contact 112, and the normally-closed fixed contact 113 and the normally-open fixed contact 114, and allows the contact reliability of the limit switch 1 to be improved.

In addition to increasing the contact surface area between the movable contact 112, and the normally-closed fixed contact 113 and the normally-open fixed contact 114, given the following reasons the inventors also increased the contact load supplied to a separable contact pair among the movable contact 112, and the normally-closed fixed contact 113 and the normally-open fixed contact 114.

That is, when the contact load applied to the contact pair in the limit switch 1 is reduced, the limit switch 1 becomes less robust against vibrations and shock; that is, reducing the contact load applied reduces the vibration resistance and shock resistance properties of the limit switch 1. The limit switch 1 has a greater inertia than a micro-switch because of having a greater mass than the micro-switch; therefore, when a reduced contact load is applied to the above-mentioned contact pairs, the above-described phenomenon occurs due to the movable contact 112, and the normally-closed fixed contact 113 and the normally-open fixed contact 114 disconnecting completely immediately after the contact load is applied.

The limit switch usually has a larger mass than a micro-switch and thus has a greater inertia. For instance, with the movable spring 111, the movable contact 112, and the movable contact piece 115 illustrated in FIG. 1, the limit switch 1 has a greater mass than the micro-switch. More specifically, the total mass of the movable spring, the movable contact, and the movable contact piece is greater than or equal to 250 g in the limit switch 1, in relation to the roughly 50 g of a micro-switch. Accordingly, the contact load required by the limit switch 1 is greater than the contact load required by the micro-switch.

Thus, the inventors experimented with a lower limit for a contact load to apply to the contact pairs, and the materials to use for the movable contact 112, the normally-closed fixed contact 113, and the normally-open fixed contact 114 in the limit switch 1 with its larger mass than the microswitch. As a result, the inventors discovered that a limit switch 1 using an Au—Ni alloy with an Au content of 97% by weight, and an Ni content of 3% for the movable contact 112, the normally-closed fixed contact 113, and the normally-open fixed contact 114, and having a contact load of 60 gf applied to a separable contact pair among the movable contact 112, and the normally-closed fixed contact 113 and the normally-open fixed contact 114 was robust against vibration and impact, and had the highest contact reliability. Further, the inventors carried out the experiments organized in Table 1 to evaluate what materials (contact materials) to use for the movable contact 112, the normally-closed fixed contact 113, and the normally-open fixed contact 114, and the size of the contact load to apply to a separable contact pair among the movable contact 112, and the normally-closed fixed contact 113 and the normally-open fixed contact 114. The details of the experiments carried out by the inventors regarding the size of the contact load to apply, and the material to use in the contact pairs (the movable contact 112, the normally-closed fixed contact 113, and the normally-open fixed contact 114) are described below using Table 1.

Overview of Table 1

TABLE 1

| | Contact Material | | | | Contact Reliability | Anti-Stick | Contact |
|---|---|---|---|---|---|---|---|
| No. | Au % | Ni % | Ag % | Other | Number of Malfunctions | Property | Load |
| 1 | 99.999 | 0 | 0 | 0 | 0 | Fail | 60 |
| 2 | 98 | 2 | 0 | 0 | 0 | Fail | 60 |
| 3 | 97 | 3 | 0 | 0 | 0 | Pass | 60 |
| 4 | 97 | 3 | 0 | 0 | 0 | Pass | 50 |
| 5 | 99.999 | 0 | 0 | 0 | 45 | Pass | 30 |
| 6 | 0 | 0 | 100 | 0 | 106 | Pass | 60 |
| 7 | 69 | 0 | 25 | 6 | 22644 | Pass | 20 |
| 8 | 69 | 0 | 25 | 6 | 88 | Pass | 20 |

Continuity tests were conducted on the limit switch 1 using different combinations of the components of the materials used (contact material) for the movable contact 112, the normally-closed fixed contact 113 and the normally-open fixed contact 114, and the contact load applied to a separable contact pair among the movable contact 112, and the normally-closed fixed contact 113 and the normally-open fixed contact 114. The results of the continuity tests are presented in Table 1 in terms of the "contact reliability (number of malfunctions)" and the "anti-stick property" respectively. Note that the unit of measure used for the contact material is the "% by weight", while the unit of measure used for the contact load is the "gf". Furthermore, the continuity tests involved repeatedly opening and closing the limit switch 1 (i.e., switching the limit switch on and off) two million (2,000,000) times.

In the above-mentioned continuity tests, the "contact reliability" represents the "number of malfunctions"; i.e., the number of times the limit switch circuit was unenergized.

Additionally, the results for the "anti-stick property" were classified as "Pass" or "Fail". A "Pass" signifies that during the above-mentioned continuity tests there was no incident of stickiness at all between the movable contact 112 and the normally-closed fixed contact 113 or normally-open fixed contact 114, or the incidents of stickiness that occurred between the movable contact 112 and the normally-closed fixed contact 113 or normally-open fixed contact 114 were not a problem during actual usage. A "Fail" signifies that "the movable contact 112, the normally-closed fixed contact 113 or the normally-open fixed contact 114 would stick and cause usage problems after being operated repeatedly a number of times".

Moreover, the above-mentioned continuity tests illustrated in Table 1 presents the use of Au, Ni, Ag, and other metals (Other) for the movable contact 112, the normally-closed fixed contact 113, and the normally-open fixed contact 114.

More details regarding the contact material and the contact load are described below.

Materials Used for the Contacts

Through comparing the Sample Nos. 1 through 3, and the Sample No. 6 the inventors discovered that the Au alloy was preferable for improving the contact reliability of the limit switch 1. Namely, the inventors discovered an Au alloy was preferable for increasing the contact surface area between the movable contact 112, and the normally-closed fixed contact 113 and the normally-open fixed contact 114 and improving the contact reliability of the limit switch 1.

As illustrated in Table 1, the Sample Nos. 1 through 3, and Sample No. 6 were all tested with a contact load of 60 gf. Additionally, the contact material included Au; in other words, there number of malfunctions for Sample Nos. 1 through 3 which contained Au alloy material for the movable contact 112, and the normally-closed fixed contact 113 and the normally-open fixed contact 114 was 0 times. In contrast, the samples not containing Au, i.e., the samples containing Ag as the material in each of the contacts, malfunctioned 106 times. Consequently, the inventors discovered that the above-mentioned Au alloy was preferable for each of the contact materials.

As a result using the Au alloy in the movable contact 112, the normally-closed fixed contact 113, and the normally-open fixed contact 114 provides for softer contacts. Gold (Au) is soft (Vickers Hardness of 25 HV to 65 HV), and is extremely anti-corrosive, and thus is often used for minute loads.

Comparing Sample Nos. 1 through 3, and Sample No. 6, the inventors also discovered that increasing the degree of hardness of the material (contact material) used for the normally-closed fixed contact 113 and the normally-open fixed contact 114 (i.e., decreasing the amount of Au contained therein) increases the number of malfunctions; in other words, the contact reliability deteriorates.

Moreover, comparing Sample Nos. 1 and 2 to Sample No. 3, the inventors also discovered that stickiness between the movable contact 112, and the normally-closed fixed contact 113 and the normally-open fixed contact 114 when the Au content in the Au alloy for each of the contacts above-mentioned; in other words, the anti-stick properties of the contacts deteriorated in this case. That is, among Sample Nos. 1 through 3 which were subject to the same contact load of 60 gf, the anti-stick property for Sample No. 1 and No. 2 were classified as fails; Sample No. 1 and No. 2 included 99.999% Au by weight and 98% Au by weight respectively. In contrast, the anti-stick property for Sample No. 3 was classified as passes, and Sample No. 3 included 97% Au by weight. Accordingly, the inventors verified that raising the Au content in the Au alloy used for each of the above-mentioned contacts degraded the anti-stick property of the contacts.

In other words, increasing the Au content in the movable contact 112, the normally-closed fixed contact 113, and the normally-open fixed contact 114 decreases the degree of hardness of the movable contact 112, the normally-closed fixed contact 113, and the normally-open fixed contact 114. Therefore, there is a greater possibility that the movable contact 112 and the fixed contacts (normally-closed fixed contact 113 and the normally-open fixed contact 114) will stick together; that is, the anti-stick property of the contacts degrades.

The situation where the anti-stick property deteriorates due to increasing the Au content is even more striking when a larger contact load is used to improve the contact reliability and simultaneously maintain the vibration resistance and the shock resistance of the contacts. The situation is particularly clear on comparing the anti-stick property of Sample No. 1 and Sample No. 5. That is, both Sample No. 1 and No. 5 have contact materials with an Au content of 99.999% by weight. However, while the contact load for Sample No. 1 is 60 gf, the contact load for Sample No. 5 is 30 gf. As a result, while the anti-stick property for Sample No. 1 is a fail, the anti-stick property for the Sample No. 5 is a pass.

Therefore, when increasing the contact load in order to simultaneously satisfying improving the contact reliability and maintaining the vibration resistance and shock resistance of the contact material, increasing the Au content in the contact material noticeably degrades the anti-stick property of the limit switch 1. This the anti-stick property degrades because increasing the Au content in the material used for the movable contact 112, the normally-closed fixed contact 113, and the normally open content 114 causes the movable contact 112, the normally close contact 113, and the normally open contract 114 to be too soft.

At that point the inventors came to realize that nickel (Ni), an extremely hard material, could be added to Au and the combination used in each of the contacts without reducing any of the other features expected from Au when the same is used in an electrical contact. In other words, the inventors discovered that it is preferable to use an Au—Ni alloy as the material in each of the above-mentioned contacts.

The inventors discovered that in order to solve the problem of deteriorating anti-stick property, and AU- and IL only had to be adopted as material used in the movable contact 112, the normally-closed fixed contact 113, and the normally-open fixed contact 114. The nickel (Ni) is an extremely hard material, and further, besides the degree of hardness, the features expected from using Au in an electrical contact do not deteriorate. Accordingly, adopting an Au—Ni alloy material in the movable contact 112, the normally-closed fixed contact 113, and the normally-open fixed contact 114 allows for increasing the degree of hardness of the movable contact 112, the normally-closed fixed contact 113, and the normally-open fixed contact 114 without degrading the properties of Au.

Here, the inventors discovered that having an Au content of 96% by weight, and an Ni content of 4% by weight or more in the Au—Ni alloy provided a material with extremely low corrosive resistance. The inventors also verified that each of the above-mentioned contacts was too hard when the amount of Ni added to the Au—Ni alloy was 4% by weight or more. Consequently, the inventors discovered that a Ni content of less than 4% by weight was preferable in the Au—Ni alloy used for each of the above mentioned contacts. Thus, using less than 4% Ni by weight in the Au—Ni alloy thereby improves the degree of hardness of the Au alloy, and improves the anti-stick property and the anti-corrosive property.

On comparing Sample Nos. 1 and 2, with Sample No. 3 the inventors also verified that at no more than 2% Ni by weight, the Ni contributed less to the Au—Ni alloy. In this case the above-mentioned contacts were too soft, and the anti-stick property thereof deteriorated. That is, among Sample Nos. 1 through 3 which were subject to the same contact load of 60 gf, the anti-stick property for Sample No. 1 and No. 2 were classified as fails; Sample No. 1 and No. 2 included 0% Ni by weight and 2% Ni by weight respectively. In contrast, the anti-stick property for Sample No. 3 was classified as a pass, and Sample No. 3 included 3% Au by weight.

From the above experiments, the inventors discovered that an Au content of no less than 97% by weight in the Au—Ni alloy used in the above-mentioned contacts improves the contact reliability of the limit switch 1, and the problems issues regarding anti-stickiness did not occur.

Note that Sample No. 3 illustrates that when the contact material for the movable contact 112, the normally-closed fixed contact 113, and a normally-open fixed contact 114 had an Au content of 97% by weight and an Ni content of 3% by weight, and the contact load was 60 gf the number of malfunctions was zero, and the anti-stick property was classified as a pass.

Similarly, Sample No. 4 illustrates that when the movable contact 112, the normally-closed fixed contact 113, and the normally-open fixed contact 114 had an Au content of 97% by weight, and an Ni content of 3% by weight and the contact load was 50 gf, the number of malfunctions was zero, and the anti-stick property was classified as a pass.

Sample No. 6 through No. 8 illustrate the continuity tests conducted by the inventors where Au was not used as the material for the movable contact 112, the normally-closed fixed contact 113, and the normally-open fixed contact 114, as well as where a gold alloy was used besides the Au—Ni alloy.

Sample No. 6 illustrates when Ag was used for the movable contact 112, the normally-closed fixed contact 113, and the normally-open fixed contact 114 (i.e., the Ag content is 100% by weight), and the contact load was 60 gf. The following results were obtained on comparing Sample No. 6, which was subject to a contact note of 60 gf with Sample No. 3 which only differed in terms of the material used for the movable contact 112, the normally-closed fixed contact 113, and the normally-open fixed contact 114. In other words, the Sample 3 and Sample No. 6 were both tested with a contact load of 60 gf. Despite that, Sample No. 6 which used Ag in the movable contact 112, the normally-closed fixed contact 113, and the normally-open fixed contact 114 exhibited a number of malfunctions of 106 times; in contrast, Sample No. 3 which used an Au—Ni alloy with an Au content of 97% by weight and an Ni content of 3% by weight exhibited a number of malfunctions of 0 times. Accordingly, when increasing the contact load to simultaneously improve the contact reliability and maintain vibration resistance and the shock resistance, using an Au—Ni alloy for the movable contact 112, the normally-closed fixed contact 113, and the normally-open fixed contact 114 is preferable.

Sample No. 7 illustrates when a compound material having an Au content of 69% by weight, an Ag content of 25% by weight, other metal content of 6% by weight was used for the movable contact 112, the normally-closed fixed contact 113, and the normally-open fixed contact 114, and the contact load was 20 gf.

Sample No. 8 illustrates when a compound material having an Au content of 69% by weight, an Ag content of 25% by weight, and 6% by weight of other metal content different from the metals used in Sample No. 7 was used for the movable contact 112, the normally-closed fixed contact 113, and the normally-open fixed contact 114, and the contact load was 20 gf.

Note that, in Table 1 Sample No. 7 and Sample No. 8 both include 6% by weight of "Other (i.e., metals besides Au, Ni, Ag)" content in the materials used for the movable contact 112, the normally-closed fixed contact 113, and the normally-open fixed contact 114. However, the metal used as "Other" in Sample No. 7 is different from the metal used as "other" in Sample No. 8, and within the results of the above mentioned continuity tests the number of malfunctions differs between Sample No. 7 and Sample No. 8. In other words, within the results from the above-mentioned continuity tests, Sample No. 7 has a number of malfunctions of 22,644 times relative to Sample No. 8 with a number of malfunctions at 88 times.

Sample No. 7 and Sample No. 8 were both tested with a contact load of 20 gf. The number of malfunctions that occurred during the above-mentioned continuity tests was 22,644 times for Sample No. 7 and 88 times for Sample No. 8. Consequently, it is clear from the results of the continuity tests that the contact reliability is low (malfunctions occur) in Sample No. 7 and Sample No. 8 when a contact load of 20 gf is applied to a separable contact pair among the movable contact 112, and the normally-closed fixed contact 113 and the normally-open fixed contact 114.

Additionally, Sample No. 5 illustrates that the anti-stick property was classified as a pass with a contact load of 30 gf, even with an Au content of 99.999%. Despite that, with regard to the contact reliability of Sample No. 5 in the above-mentioned continuity tests, it can be seen that malfunctions occurred 45 times in Sample No. 5. Namely, although there are no issues with the anti-stick property, reducing the contact load applied to a separable contact pair among the movable contact 112, and the normally-closed fixed contact 113 and the normally-open fixed contact 114 reduces the contact reliability. A lower limit value for the contact load is described in detail below.

The Size of the Contact Load

Comparing Sample Nos. 1 through 4 with Sample Nos. 5 through 8, the number of malfunctions for Sample Nos. 1 through 4 is 0 times (i.e., the contact reliability is sufficiently high), while in contrast the number of malfunctions for Sample Nos. 5 through 8 is 45 to 22,644 times (i.e., the contact reliability is low).

As is made clear by comparing Sample No. 6 and Sample No. 3, Sample No. 6 conceivably has a number of malfunctions of 45 times because Ag was used for the movable contact 112, the normally-closed fixed contact 113, and the normally-open fixed contact 114. That is, the reason the number of malfunctions for Sample No. 6 is 45 times is conceivably due to the materials (contact material) used for the movable contact 112, the normally-closed fixed contact 113, and the normally-open fixed contact 114. Consequently, Sample Nos. 1 through 4 are compared to Sample Nos. 5, 7, and 8 when discussing the evaluation of the contact load applied to a separable contact pair among the movable contact 112, and the normally-closed fixed contact 113 and the normally-open fixed contact 114.

In Table 1 the number of malfunctions for Sample Nos. 1 through 4 is 45 times with contact loads of 50 gf through 60 gf; in contrast, the number of malfunctions for Sample Nos. 5, 7, and 8 is 45 through 22,644 times with contact loads of 20 gf through 30 gf. That is, the contact reliability is sufficiently high when the contact load is 50 gf through 60 gf, however, the contact reliability is low when the contact load is 20 gf through 30 gf. The inventors thus discovered from the above-mentioned results that it is preferable to apply a contact load of no less than 40 gf, which is between the 30 gf through 50 gf to a separable contact pair among the movable contact 112, and the normally-closed fixed contact 113 and the normally-open fixed contact 114.

The inventors' considerations regarding the results shown in Table 1 are discussed below.

Considerations on the Experimental Results Presented in Table 1 The inventors discovered that using an Au alloy in the movable contact 112, the normally-closed fixed contact 113, and the normally-open fixed contact 114 is preferable by comparing Sample Nos. 1 through 3 with Sample No. 6.

By comparing Sample Nos. 1 and 2 with Sample Nos. 3 and 4 the inventors also discovered that sticking occurred between each of the contacts, i.e., the anti-stick property deteriorated when the movable contact 112, the normally-closed fixed contact 113, and the normally-open fixed contact 114 possessed a small degree of hardness. In other words, the inventors verified that sticking occurred between the movable contact 112, the normally-closed fixed contact 113, and the normally-open fixed contact 114 on increasing the Au content in the Au alloy used in the movable contact 112, the normally-closed fixed contact 113, and the normally-open fixed contact 114.

The limit switch 1, which has a larger mass to a micro-switch in particular has a larger amount of inertia than a micro-switch. Consequently, the movable contact 112, the normally-closed fixed contact 113, and the normally-open fixed contact 114 disconnect immediately when the contact load applied between the above-mentioned contact pairs is reduced. Therefore, the contact load between the above-mentioned contact pairs in the limit switch 1, which has a larger mass than a micro-switch, is larger than the contact load required by a micro-switch. Here, there is a greater possibility that the contacts will adhere to each other when the contact load applied to the above-mentioned contact pair increases.

The inventors compared Sample Nos. 1 and 2 with Sample Nos. 3 and 4 and discovered that the contact reliability for a limit switch 1 which has a larger mass than a micro-switch improved, and no problems occurred in relation to the anti-stick property, the shock resistance, and the vibration resistance of the limit switch 1 when the Au content in the material used in each of the above-mentioned contact pairs was no less than 97% by weight.

The inventors also compared Sample Nos. 1 through 4 with Sample Nos. 5, 7, and 8, and verified that the number of malfunctions increased, i.e., the contact reliability deteriorated when a smaller contact load was applied between each separable contact pair among the movable contact 112 and the fixed contacts (the normally-closed fixed contact 113 and the normally-open fixed contact 114).

More specifically, the inventors discovered that it is preferable to apply a contact load of no less than 40 gf, which is between the 30 gf through 50 gf to a separable contact pair among the movable contact 112, and the normally-closed fixed contact 113 and the normally-open fixed contact 114.

Thus, the inventors reduced the degree of hardness of the material used in each of the contacts (the movable contact 112, the normally-closed fixed contact 113, and the normally-open fixed contact 114) to thereby increase the contact surface area between the movable contact 112 and the fixed contacts (the normally-closed fixed contact 113 and the normally-open fixed contact 114). More specifically, the inventors used an Au alloy in the movable contact 112 and the fixed contacts (the normally-closed fixed contact 113 and the normally-open fixed contact 114) which increased the contact surface area between the movable contact 112 and the fixed contacts (the normally-closed fixed contact 113 and the normally-open fixed contact 114), and improved the contact reliability of the limit switch 1.

More specifically, the inventors selected to use no less than 97% Au by weight for the Au content in the material used in each of the above mentioned contacts.

However, given that the limit switch 1 has a larger mass than the micro-switch, the contact load applied to a separable contact pair among the movable contact 112, and the normally-closed fixed contact 113 and the normally-open fixed contact 114 must be larger than the contact load applied to the electrical contacts in the micro-switch. Therefore, there is a greater possibility that the movable contact 112 and the fixed contacts (normally-closed fixed contact 113 and the normally-open fixed contact 114) will stick together; that is, the anti-stick property of the contacts degrades on increasing the contact load.

At that point the inventors came to realize that nickel (Ni), an extremely hard material, could be added to Au and the combination thereof used in each of the contacts without lessening any of the other features expected from Au when Au is used in an electrical contact. That is, the inventors were able to maintain the anti-stick property of the limit switch 1, which has a larger mass than the micro-switch, and improve the contact reliability of the limit switch 1 by providing an Au content of 97% or more by weight in the movable contact 112 and the fixed contacts (the normally-closed fixed contact 113 and the normally-open fixed contact 114).

In other words, as can be understood from the results presented in Table 1, while in terms of the contact reliability the number of malfunctions was 0 times for Sample Nos. 1 and 2, the anti-stick property is classified as a fail. Additionally, while the anti-stick property was classified as a pass for Sample Nos. 5 through 8, there were malfunctions in terms of the contact reliability. In contrast, the number of malfunctions was zero, and the contact reliability improved for Sample Nos. 3 and 4, and the anti-stick property was classified as a pass.

Accordingly, it is preferable for the movable contact 112, the normally-closed fixed contact 113, and the normally-open fixed contact 114 to be formed from an Au—Ni alloy of no less than 97% Au by weight.

An Au—Ni alloy having an Au content of 97% by weight provided improved contact reliability and avoided the deterioration of the anti-stick property compared to Sample Nos. 1, 2, and 5 through 8.

In addition, due to comparing Sample Nos. 1 through 4 with Sample Nos 5, 7, and 8, the inventors also increased the contact load applied to a separable contact pair among the movable contact 112, and the normally-closed fixed contact 113 and the normally-open fixed contact 114. Therefore, applying a larger contact load to the above-mentioned contact pairs increased the contact surface area between the movable contact 112, and the normally-closed fixed contact 113 and the normally-open fixed contact 114 and improved the contact reliability. Applying the larger contact load also made it possible to avoid deterioration in the vibration resistance and the shock resistance of the limit switch 1 which has a greater mass than a micro-switch.

More specifically, the inventors discovered that a contact load of no less than 40 gf is preferable for application to a separable contact pair among the movable contact 112, and the normally-closed fixed contact 113 and the normally-open fixed contact 114. That is, the inventors discovered that it is preferable to use a movable spring 111 capable of applying a contact load of no less than 40 gf on a separable contact pair among the movable contact 112, and the normally-closed fixed contact 113 and the normally-open fixed contact 114.

As can be understood from the results in Table 1, a contact load of less than 40 gf (more specifically, 20 gf to 30 gf) was applied to the above-mentioned contact pairs in Sample Nos. 5, 7, and 8; although the anti-stick property was classified as a pass for Sample Nos. 5, 7, and 8, malfunctions occurred with regard to the contact reliability. In contrast, the contact reliability in Sample Nos. 3 and 4 was improved where the number of malfunctions registered for were zero with a contact load of no less than 40 gf (specifically, 50 gf to 60 gf), and the anti-stick property was classified as a pass.

Therefore, it is preferable to use a movable spring 111 capable of applying a contact load of no less than 40 gf in the limit switch 1 on a separable contact pair among the movable contact 112, and the normally-closed fixed contact 113 and the normally-open fixed contact 114.

CONCLUSIONS

In a limit switch (1) according to the first embodiment, the fixed contacts (normally-closed fixed contact 113 and the normally-open fixed contact 114) and the movable contact (1120 are formed from an Au—Ni alloy including no less than 97% Au by weight.

The above-mentioned configuration improves contact reliability of the above-mentioned limit switch. That is, no contact malfunctions occur in the above-mentioned limit switch.

Moreover, the above-mentioned limit switch prevents deterioration in the anti-stick property thereof.

Here, given that the limit switch has a larger mass, and therefore a larger amount of inertia compared to a micro-switch, the contact load applied to a separable contact pair among the above-mentioned movable contact and the fixed contacts needs to be larger than the contact load required by the micro-switch. However, this increases the danger that the contacts will completely adhere to each other when the contact load applied to the above-mentioned contact pairs increases.

In contrast, a limit switch equipped with the above-mentioned fixed contacts and movable contact formed from an Au—Ni alloy including no less than 97% Au by weight reduces the risk that the above-mentioned fixed contacts and the movable contact will stick to each other, i.e., this reduces the risk that the anti-stick property of the contacts deteriorate.

A limit switch according to a second embodiment may further provide a contact pressure spring (movable spring 111) to the limit switch according to the above-mentioned first embodiment that applies a contact load of no less than 40 gf to a separable contact pair among the above-mentioned fixed contacts, and the above-mentioned movable contact.

The above-mentioned configuration prevents the complete deterioration of the vibration resistance and the shock resistance of the limit switch due to applying a contact load of no less than 40 gf to the above-mentioned contact pairs regardless of whether the limit switch has a larger mass and a larger amount of inertia than the micro-switch.

Moreover, applying a contact load or no less than 40 gf to the above-mentioned contact pairs increases the contact surface area between the above-mentioned fixed contacts and the movable contact, thereby improving the contact reliability thereof.

A limit switch according to the third embodiment of the invention may form the above-mentioned fixed contacts and the above-mentioned movable contact from an Au—Ni alloy having no less than 97% and less than 98% Au by weight.

The above-mentioned configuration reduces the risk in the limit switch that the degree of hardness of the above-mentioned fixed contacts and the above-mentioned movable contact decreases and the above-mentioned fixed contacts and movable contact will stick together; i.e., the above configuration prevents the degradation of the anti-stick property of the limit switch.

The present invention is not limited to each of the above described embodiments, and may be modified in various ways and remain within the scope of the claims. The technical means disclosed in each of the different embodiments may be combined as appropriate, and an embodiment obtained in such a manner remains within the technical scope of the present invention.

INDUSTRIAL APPLICABILITY

The invention is suitable for use in limit switches.

The invention claimed is:

1. A limit switch comprising:

fixed contacts and a movable contact, the fixed contacts and the movable contact formed from an Au—Ni metal alloy of no less than 97% Au by weight; and a contact pressure spring that applies a contact load of no less than 40 gf to a separable contact pair among the fixed contacts and the movable contact, wherein the fixed contacts and the movable contact formed from an Au—Ni metal alloy of no less than 97% Au and less than 97.7% Au by weight.

* * * * *